US005252420A

United States Patent [19]

Tanaka et al.

[11] Patent Number: 5,252,420

[45] Date of Patent: Oct. 12, 1993

[54] DEVELOPER COMPOSITION FOR ELECTROPHOTOGRAPHY

[75] Inventors: Shingo Tanaka, Kainan; Tetsuya Ueno; Koji Nishibuchi, both of Wakayama, all of Japan

[73] Assignee: KAO Corporation, Tokyo, Japan

[21] Appl. No.: 722,311

[22] Filed: Jun. 27, 1991

[30] Foreign Application Priority Data

Jul. 6, 1990 [JP] Japan ..... 2-179822

[51] Int. Cl.[5] ..... G03G 9/08

[52] U.S. Cl. ..... 430/109; 430/110; 430/114

[58] Field of Search ..... 430/109, 110, 114

[56] References Cited

U.S. PATENT DOCUMENTS

| | | | |
|---|---|---|---|
| 4,147,645 | 4/1979 | Lu | 252/62.1 |
| 4,387,211 | 6/1983 | Yasuda et al. | 528/179 |
| 4,657,837 | 4/1987 | Morita et al. | 430/109 |
| 4,693,952 | 9/1987 | Koizumi et al. | 430/109 |
| 4,804,622 | 2/1989 | Tanaka et al. | 430/109 |
| 4,939,059 | 7/1990 | Kawabe et al. | 430/109 |

FOREIGN PATENT DOCUMENTS

| | | |
|---|---|---|
| 0259642 | 3/1988 | European Pat. Off. . |
| 0320819 | 6/1989 | European Pat. Off. . |

*Primary Examiner*—Marion E. McCamish
*Assistant Examiner*—S. Rosasco
*Attorney, Agent, or Firm*—Birch, Stewart, Kolasch & Birch

[57] ABSTRACT

The present invention is directed to a developer composition for electrophotography containing a binder resin comprising at least a polyester resin as the main component, a colorant and a bisphenol A alkylene oxide adduct, wherein said bisphenol A alkylene oxide adduct is contained in a ratio of not less than 1.0 part by weight and not more than 10.0 parts by weight to 100 parts by weight of the binder resin. The developer composition of the present invention possesses satisfactory low-temperature fixability and is excellent in offset resistance, storage stability and resin pulverizability.

11 Claims, 2 Drawing Sheets

DEVELOPER COMPOSITION FOR ELECTROPHOTOGRAPHY

BACKGROUND OF THE INVENTION

The present invention relates to a developer composition for electrostatic image development in electrophotography, electrostatic recording, electrostatic printing and other fields.

As described in U.S. Pat. Nos. 2,297,691 and 2,357,809 and other publications, the electrophotography art comprises a developing process in which an electric latent image is formed by evenly charging a photoconductive insulating layer, and subsequently exposing the layer to eliminate the charge in the exposed portion. The image visualized by adhering a colored, charged, fine powder known as a toner to the latent image, a transfer process in which the obtained visible image is transferred to a image-receiving sheet such as a transfer paper, and a fixing process in which the transferred image is permanently fixed by heating, pressure application or another appropriate means of fixing.

As stated above, a toner must meet the requirements not only of the development process but also of the transfer and fixing processes.

With respect to copying machines, printers, and other electrophotographic imaging apparatus, there have recently been strong demands for higher speed and better image quality. To meet this requirement, various methods and apparatus have been developed for toner image fixing. Among these methods, the most common is the heat roller fixing method, in which heat and pressure are applied at the same time.

The high speed copying machines and other apparatus based on this fixing method are liable to cause fixing failure due to a reduction in the heat roller temperature as a result of insufficient heat supply. This insufficient heat supply is due to a considerable loss of heat from the heat roller to the image-receiving sheet which occurs because fixing is continuously carried out in a large number of cycles. It is therefore desired to develop a toner which permits fixing at lower temperature for high speed copying machines and other apparatus.

A polyester resin is essentially superior in fixing performance; it is sufficiently fixable even by the non-contact fixing method, as described in U.S. Pat. No. 3,590,000, for example. However, when it is used with the heat roller fixing method described above, it is liable to cause the offset phenomenon and is thus difficult to use. In the offset phenomenon, a part of the molten toner, which comes into contact with the surface of the heat roller during heat roller fixing, transfers and adheres to the surface of the heat roller, which in turn again transfers to the image-receiving sheet supplied thereafter and stains the image.

With respect to the high speed copying machines and other apparatus based on the heat roller fixing method, there are strong demands for the development of the following toners:

A) A toner excellent in offset resistance.

B) A toner excellent in low-temperature fixability.

Traditionally, various methods have been proposed for improving offset resistance, including:

1) the use of crosslinked resin (Japanese Examined Patent Publication Nos. 23354/1976 and 11902/1984 and Japanese Patent Laid-Open No. 90866/1984), 2) the introduction of a soft segment to a side chain to improve the low-temperature fixability while maintaining satisfactory offset resistance (Japanese Patent Laid-Open Nos. 109825/1982 and 7960/1984) and 3) the addition of low molecular weight polyolefin wax to provide the toner with detachability from the fixing roller (Japanese Patent Laid-Open Nos. 65232/1974 and 28840/1975).

However, in the method 1) described above, solely using a crosslinked resin increases the fixing temperature, and produces an unfixed portion under ordinary fixing conditions, resulting in image staining and other problems.

In the method 2) described above, although the fixability improves, the resin pulverizability, which is associated with toner productivity, becomes poor and the toner productivity is degraded because the resin toughness increases.

In the method 3) described above, addition of much low, molecular weight polyolefin wax leads to degradation of the charging property, due to a reduction in toner fluidity and other causes, though it is effective in the prevention of the offset phenomenon. In addition, no effect is obtained when the addition amount is small.

SUMMARY OF THE INVENTION

The present invention was developed to solve the problems described above.

Accordingly, it is an object of the present invention to provide a developer composition for electrophotography, which is fixable at lower fixing temperatures in high speed copying machines and printers equipped with a heat roller fixer and which possesses good offset resistance.

It is another object of the present invention to provide a developer composition for electrophotography, which is good in fluidity, which is free of blocking, and which has a long service life (i.e., is not liable to deterioration).

It is still another object of the present invention to provide a developer composition for electrophotography which offers good resin pulverizability during toner production.

To accomplish the objects described above, the present inventors made intensive investigations and developed the present invention.

Accordingly, the present invention relates to:

(1) a developer composition for electrophotography containing a binder resin comprising at least a polyester resin as the main component, a colorant and a bisphenol A alkylene oxide adduct, wherein said bisphenol A alkylene oxide adduct is contained in a ratio of not less than 1.0 part by weight and not more than 10.0 parts by weight, to 100 parts by weight of the binder resin, (2) the developer composition for electrophotography described in (1) above wherein said polyester resin contains at least one kind of trifunctional compound or higher polyfunctional compound as a constituent unit thereof in a ratio of not less than 0.5 mol % and below 15.0 mol % to the total monomer content, and (3) the developer composition for electrophotography described in (1) or (2) above wherein said polyester resin has a softening point of not less than 95.0° C. and not more than 160.0° C. as determined using a flow tester of the "koka-shiki" type, a glass transition temperature of not less than 50.0° C. and not more than 80.0° C. as determined using DSC and an acid value of not more than 20 KOH mg/g.

DETAILED DESCRIPTION OF THE INVENTION

Figure 1:
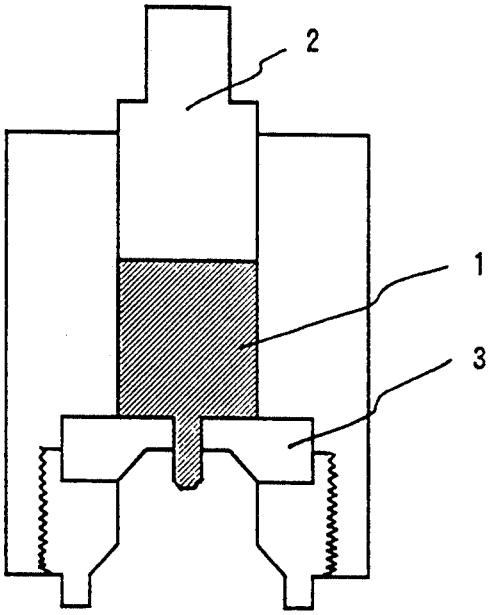
FIG. 1 is a cross-sectional view of a flow tester of the "koka-shiki" type.

The developer composition for electrophotography of the present invention contains a binder resin comprising at least a polyester resin as the main component, a colorant and a bisphenol A alkylene oxide adduct, wherein said bisphenol A alkylene oxide adduct must be contained in a ratio of not less than 1.0 part by weight and not more than 10.0 parts by weight, preferably not less than 3.0 parts by weight and not more than 10.0 parts by weight, and more preferably not less than 3.0 parts by weight and not more than 7.0 parts by weight based on 100 parts by weight of the binder resin.

If the ratio of the bisphenol A alkylene oxide adduct in the developer composition is less than 1.0 part by weight to 100 parts by weight of the resin, it has no fixability improving effect. On the other hand, if the ratio exceeds 10.0 parts by weight, the fluidity, charging property, blocking resistance and other properties of the toner are degraded, and the offset resistance decreases.

The bisphenol A alkylene oxide adduct can be contained in the developer composition by allowing the bisphenol A alkylene oxide adduct, as an unreacted monomer from polyesterification, to remain in the resin.

Specifically, this is achieved by, for example, controlling both the degree of polymerization of the polyester resin and the feed ratio of acid and alcohol component. The degree of polymerization of the polyester resin is closely related to the softening point as measured using a flow tester of the "koka-shiki" type, a key parameter of the present invention. It is desirable that the softening point, as measured using a flow tester of the "koka-shiki" type, be not less than 95.0° C. and not more than 160.0° C., and the ratio of the number of acid component functional groups and the number of alcohol component functional groups be 0.65:1 to 0.95:1 in the preparing stage for the polyester resin.

Traditionally, the monomer constituting the resin has been regarded as undesirable when it remains in toner particles, because it bleeds out on the toner particle surface and degrades the fluidity, charging property, blocking resistance and other properties of the toner.

However, the present inventors have found that the presence of a bisphenol A alkylene oxide adduct as an unreacted monomer, in a particular range of content, has a fixing strength improving effect without being accompanied by degradation of the fluidity, charging property, blocking resistance and other properties of the toner, and have developed the present invention. With respect to the reason why the fluidity, charging property, blocking resistance and other properties of the toner are not degraded when the bisphenol A alkylene oxide adduct remains in the polyester resin, and this resin is used for a toner, the following speculation is possible. The bisphenol A alkylene oxide adduct is considered to be not liable to bleed out on the toner particle surface due to its interaction with the polyesterification ester group, or the terminal carboxyl group, hydroxyl group and other groups.

Moreover, when the bisphenol A alkylene oxide adduct is present in the system already in the initial stage of polyesterification, it is speculated that the adduct is dispersed in the polyester resin at the molecular level and its interaction is stronger.

The bisphenol A alkylene oxide adduct is represented by the following formula:

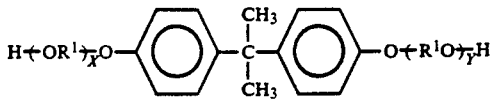

wherein $R^1$ represents an alkylene group having a carbon number of 2 to 4; X and Y independently represent a positive integer, with a total of 2 to 16 on average.

Specific examples of the bisphenol A alkylene oxide adduct include polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxyethylene(2.5)-2,2-bis(4-hydroxyphenyl)propane, polyoxypropylene(2.0)-polyoxyethylene(2.0)-2,2-bis(4-hydroxyphenyl)propane and polyoxypropylene(6.0)-2,2-bis(4-hydroxyphenyl)propane.

In the present invention, the ratio of the unreacted monomer of bisphenol A alkylene oxide adduct remaining in the polyester resin can be determined as follows:

After an aliquot of the low molecular weight moiety is taken by preparative GPC, the unreacted monomer is quantified by HPLC.

The conditions of separation of the low molecular weight moiety by preparative GPC are as follows:

Column: Nippon Bunseki Kogyo JAI GEL 2H (20 mm dia.×50 cm), two units

Eluent: Chloroform

Flow rate: About 3.4 ml/min

Injection: 7.9 ml of 1% (w/v) sample solution is injected using a loop injector.

Detection: RID

An aliquot of the solution containing the unreacted monomer is taken, and the chloroform is evaporated under reduced pressure.

The HPLC quantitative determination conditions are as follows:

Preparation of analytical sample solution: The entire amount of the dry solid taken by GPC is washed down into a 5 ml measuring flask with THF and filled up to a given volume.

Column: TSK Gel ODS-120T (4.6 mm dia.×250 mm)

Eluent: THF/water=50/50

Flow rate: 1.0 ml/min

Column temperature: 40° C.

Injection: 20 μl

Detection: UV 280 nm

The content is determined using the working curve drawn previously.

To add the bisphenol A alkylene oxide adduct to the developer composition, mixing in a molten state using a known means such as a kneader is also possible. This method of mixing in a molten state may be carried out in combination with the above-mentioned method using the unreacted monomer in polyesterification.

Examples of the diol component of the monomer which constitutes the polyester resin of the present invention include the above-mentioned bisphenol A alkylene oxide adduct, aliphatic diols such as ethylene glycol, diethylene glycol, triethylene glycol, 1,2-propylene glycol, 1,3-propylene glycol, 1,4-butanediol, neopentyl glycol, 1,5-pentanediol, 1,6-hexanediol, 1,4-cyclohexanedimethanol, dipropylene glycol, polyethylene glycol, polypropylene glycol and polytetramethylene glycol and other diols.

When using the bisphenol A alkylene oxide adduct as a constituent monomer, a polyester resin having a relatively high glass transition temperature attributable to the nature of the bisphenol A skeleton is obtained, which offers good blocking resistance. Also, since the bisphenol A skeleton has a high molecular weight, it contributes to increasing the molecular weight of the polymer, and has an enhancing effect on offset resistance.

Examples of the dicarboxylic acid component of the monomer which constitutes the polyester resin of the present invention include maleic acid, fumaric acid, citraconic acid, itaconic acid, glutaconic acid, phthalic acid, isophthalic acid, terephthalic acid, succinic acid, adipic acid, sebacic acid, azelaic acid, malonic acid and dicarboxylic acids represented by the following formula:

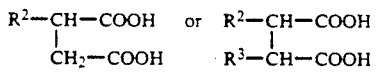

wherein $R^2$ and $R^3$ independently represent a saturated or unsaturated hydrocarbon group having a carbon number of 4 to 20, such as n-dodecylsuccinic acid, n-dodecenylsuccinic acid, n-octylsuccinic acid, isododecylsuccinic acid, isododecenylsuccinic acid and n-octenylsuccinic acid, anhydrides or lower alkyl esters of these dicarboxylic acids, and other dicarboxylic acids.

The polyester resin of the present invention must be partially crosslinked in the molecule. Crosslinking is achieved by using a trifunctional compound or a higher polyfunctional compound. Examples of triol or higher polyols which can be used as crosslinking agents include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxymethylbenzene.

Example of tricarboxylic acid or higher polycarboxylic acids which can be used as crosslinking agents include 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxylpropane, 1,2,4-cyclohexanetricarboxylic acid, tetra(methylenecarboxyl)methane, 1,2,7,8-octanetetracarboxylic acid, pyromellitic acid, Empol trimer acid and anhydrides or lower alkyl esters thereof. Of these tricarboxylic acids or higher polycarboxylic acids, trimellitic anhydride is particularly preferred.

The trifunctional compound or higher polyfunctional compound can be used in ratios of not less than 0.5 mol % and less than 15.0 mol %, preferably not less than 1.5 mol % and less than 12.0 mol %, and more preferably not less than 2.5 mol % and less than 10.0 mol % to the total amount of the monomer.

Although the triol or higher polyols and tricarboxylic acid or higher polycarboxylic acids may be used singly or in combination, a total content exceeding 15.0 mol % is undesirable, since it is difficult to control the molecular weight.

When using a trifunctional compound or higher polyfunctional compound, a ratio of less than 0.5 mol % of the total monomer content is undesirable, since the resin pulverizability is poor, which in turn degrades the toner pulverizability.

Also, the softening point of the polyester resin for the present invention, as determined using a flow tester of the "koka-shiki" type, is preferably not less than 95.0° C. and not more than 160.0° C. A softening point below 95.0° C. degrades the offset resistance and blocking resistance; if the softening point exceeds 160.0° C., the low-temperature fixability is degraded.

The softening point of the polyester resin for the present invention as determined using a flow tester of the "koka-shiki" type is defined as follows:

The softening point is defined as the temperature corresponding to half the height of from the flow starting point to the flow end point measured using a flow tester of the "koka-shiki" type (CFT-500) available from Shimadzu Corporation when a 1 $cm^3$ sample is molten and flows out under conditions of a dice pore size of 1 mm, a pressure of 20 $kg/cm^2$ and a temperature elevation rate of 6° C./min.

Figure 2:
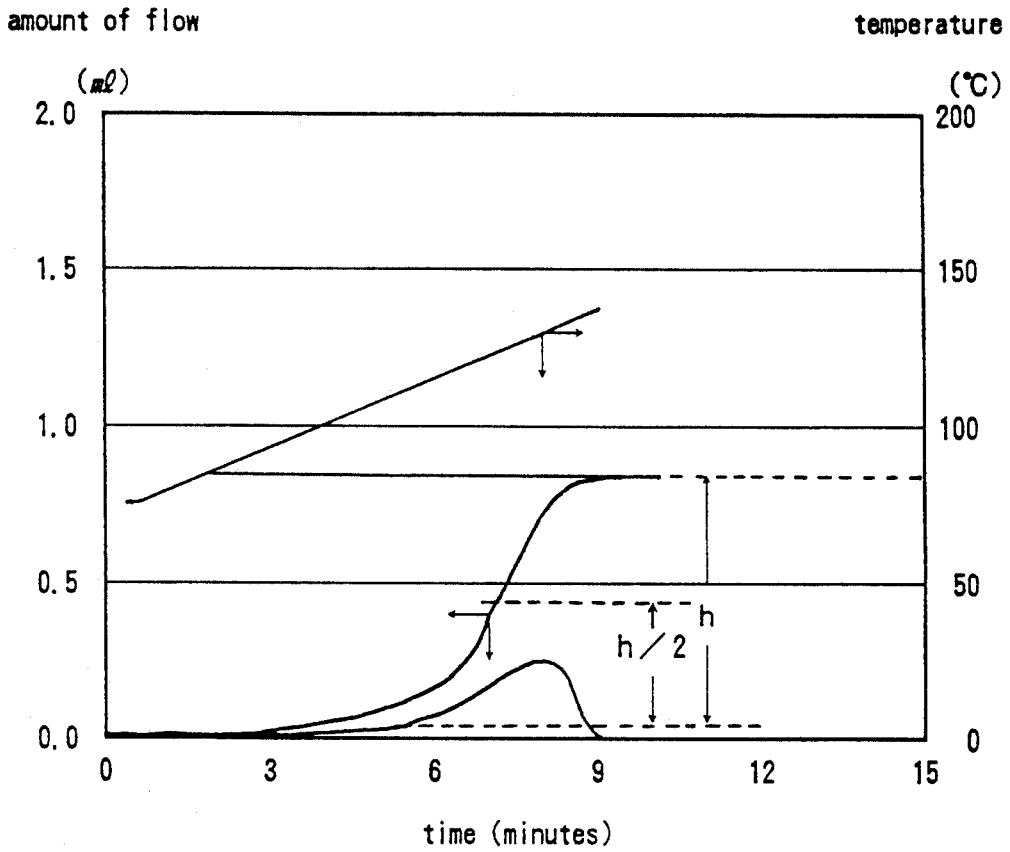
FIG. 2 is a graph showing a plunger fall distance (amount of flow)-temperature curve for the determination of the softening point. The reference numbers denote the following; 1: sample, 2: plunger, 3: nozzle.

Specifically, as shown in FIG. 1, a load of 20 $kg/cm^2$ from the plunger 2 of the flow tester is applied onto 1 $cm^3$ of a sample 1 heated at a temperature elevation rate of 6° C./min to extrude the sample through a nozzle 3 having a diameter of 1 mm and a length of 1 mm, while preparing a plunger fall distance (amount of flow)-temperature curve with respect to the flow tester as shown in FIG. 2, from which a temperature corresponding to h/2, wherein h is the height of the S curve, is found to be defined as the softening temperature.

The polyester resin used for the present invention can be produced by condensation polymerization of a polycarboxylic acid component and a polyol component in an inert gas atmosphere at a temperature of 180° to 250° C. In this case, to promote the reaction, an esterification catalyst in common use such as zinc oxide, stannous oxide, dibutyltin oxide or dibutyltin dilaurate can be used. For the same purpose, the production may be carried out under a reduced pressure.

Concerning another property of the polyester resin thus obtained, the glass transition temperature, as determined using DSC (differential scanning calorimetry) is preferably not less than 50.0° C. and not more than 80.0° C. If the glass transition temperature is below 50.0° C., the blocking resistance is degraded, and if it exceeds 80.0° C., the low-temperature fixability is degraded.

As still another property of the polyester resin thus obtained, the acid value is preferably not more than 20 KOH mg/g, more preferably not more than 10 KOH mg/g, and still more preferably not more than 6 KOH mg/g. Acid values exceeding 20 KOH mg/g are undesirable, since the moisture resistance worsens, and the charge amount decreases, particularly at high humidity.

Examples of colorants which can be used for the present invention include various carbon blacks produced by the thermal black method, acetylene black method, channel black method, furnace black method, lamp black method and other methods in the case of black toners, and copper phthalocyanine, monoazo pigments (C. I. Pigment Red 5; C. I. Pigment Orange 36; C. I. Pigment Red 22), dis-azo pigments (C. I. Pigment Yellow 83), anthraquinone pigments (C. I. Pigment Blue 60), dis-azo pigments (Solvent Red 19) and Rhodamine dyes (Solvent Red 49) in the case of color toners. These colorants are thoroughly uniformly dispersed with a polyester resin in the presence of a positive or negative charge control agent, added as necessary using a ball mill or another means, after which they are kneaded in a molten state using a kneader, cooled and then pulverized to yield a colored powder having an average particle size of 5 to 15μ which is used as a toner. Said toner as a dry two-component developer is blended in an appropriate ratio with a magnetic powder such as an amorphous carrier, ferrite coat carrier or spherical coat carrier, and this mixture is used as a developer.

Any positive charge control agent can be used for the present invention without limitation, ranging from low molecular compounds to high molecular compounds including polymers. Examples of the positive charge control agent include Nigrosine dyes "Nigrosine Base EX", "Oil Black BS" and "Oil Black SO" (all produced by Orient Chemical Co., Ltd.), triphenylmethane dyes, quaternary ammonium compounds and vinyl polymers containing an amino group.

Examples of negative charge control agents which can be used for the present invention include metal complex salts of monoazo dyes, nitrohumic acid and its salt, substances having a nitro group or halogen element, sulfonated copper phthalocyanine and maleic anhydride copolymers.

To adapt to the developing mechanism or improve the image quality, magnetic powder may be contained in the toner. Examples of the magnetic powder include alloys or compounds containing a ferromagnetic element, such as ferrite and magnetite. Said magnetic material can be used in the form of a fine powder having an average particle size of 0.05 to 1μ in a dispersion in the polyester resin at 30 to 70% by weight.

Examples of known property improving agents contained in the toner of the present invention include anti-offset agents, fluidizing agents and thermal property improving agents (e.g., metal complexes such as 3,5-di-tertiary-butylsalicylic acid chromium complex, and metal oxides such as zinc oxide), and their appropriate use does not interfere with the present invention.

The developer composition for electrophotography of the present invention thus obtained possesses satisfactory low-temperature fixability, which meets the requirements of fixing using high speed copying machines and other apparatus because it incorporates a polyester resin which is essentially excellent in fixability, and because it contains a bisphenol A alkylene oxide adduct. Also, it offers excellent offset resistance because it has a crosslinked structure. It is also excellent in storage stability and resin pulverizability.

EXAMPLES

The present invention is hereinafter described in more detail by means of the following examples, but the invention is not to be interpreted as limited by these examples.

PREPARATION EXAMPLE 1

Binder Resin 1

5.0 mol of polyoxypropylene(2.2-2,2-bis(4-hydroxyphenyl)propane, 5.0 mol of ethylene glycol, 7.0 mol of terephthalic acid, 1.0 mol of 1,2,4-benzenetricarboxylic anhydride (trimellitic anhydride) and 5.0 g of dibutyltin oxide were placed in a four-necked glass flask, and a thermometer, a stainless steel stirring rod, a condenser and a nitrogen-inlet tube were attached thereto. Reaction was carried out in nitrogen stream in a mantle heater at 190° C. for 3 hours, 220° C. for 3 hours, 240° C. for 3 hours and at 240° C. and a reduced pressure of 60 mmHg for 1 hour.

The obtained resin was a light yellow solid, having a softening point of 118° C. as determined using the flow tester and a glass transition temperature of 62° C. as determined using DSC. The content of the unreacted monomer of bisphenol A alkylene oxide adduct was 3.0 parts by weight based on 100 parts by weight of the resin.

The obtained resin is hereinafter referred to as binder resin 1.

PREPARATION EXAMPLES 2 THROUGH 5

Binder Resins 2 Through 5

Using the starting material compositions shown in Table 1, the same procedure as in Preparation Example 1 was followed to yield binder resins 2 through 5. Table 1 shows the softening point as determined using the flow tester, the glass transition temperature as determined using DSC and the content of the unreacted monomer of bisphenol A alkylene oxide adduct of the obtained resins. The acid value of the obtained binder resin 1 was 3.5 KOH mg/g. The acid values of binder resins 2 through 5 were 1.9, 18.2, 18.5 and 1.5 KOH mg/g, respectively.

TABLE 1

| | Binder resin | | | | |
|---|---|---|---|---|---|
| Monomer | Binder resin 1 | Binder resin 2 | Binder resin 3 | Binder resin 4 | Binder resin 5 |
| Polyoxypropylene(2.2)-2,2-bis (4-hydroxyphenyl)propane A | 5.0 | 7.0 | 5.5 | | 5.0 |
| Polyoxyethylene(2.0)-2,2-bis (4-hydroxyphenyl)propane B | | | | | 5.0 |
| Ethylene glycol | 5.0 | | 4.0 | 5.0 | |
| Diethylene glycol | | 2.5 | | | |
| Neopentyl glycol | | | | 5.0 | |
| Glycerin | | 0.5 | 0.5 | | |
| Pentaerythritol | | | | 0.5 | |
| Terephthalic acid | 7.0 | 6.0 | 5.0 | 4.5 | 5.0 |
| Isophthalic acid | | | | 4.5 | |
| Fumaric acid | | | 3.0 | | |
| Trimellitic anhydride | 1.0 | 1.5 | 1.0 | 0.5 | 2.0 |

TABLE 1-continued

| Monomer | Binder resin 1 | Binder resin 2 | Binder resin 3 | Binder resin 4 | Binder resin 5 |
|---|---|---|---|---|---|
| Softening point using a flow tester (°C.) | 118 | 128 | 120 | 125 | 123 |
| Glass transition temperature (°C.) | 62 | 63 | 65 | 64 | 49 |
| Unreacted monomer of bisphenol A alkylene oxide adduct* (part by weight) | 3.0 | 6.0 | 0.5 | 0.0 | 15.0 |

*represents unreacted monomer of bisphenol A alkylene oxide adduct indicated as A and B in the table.

EXAMPLE 1

Materials in the following composition were mixed using a Henschel mixer and then mixed in a molten state using a twin screw compounder and cooled, after which the mixture was subjected to ordinary pulverization and classification processes to yield a toner having an average particle size of 11 μm.

Composition

Binder resin 1: 90 parts

Carbon black #44 (produced by Mitsubishi Chemical Industries Ltd.): 7 parts

Negative charge control agent Bontron S-34 (manufactured by Orient Chemical Co., Ltd.): 2 parts

EXAMPLE 2

The same procedure as in Example 1 was followed except that the binder resin 1 was replaced with the binder resin 2.

EXAMPLE 3

The same procedure as in Example 1 was followed except that the binder resin 1 was replaced with the binder resin 3 and 3 parts of polyoxypropylene(2.2)-2,2-bis(4-hydroxyphenyl)propane was added upon mixing in a molten state using the twin screw compounder.

EXAMPLE 4

The same procedure as in Example 3 was followed except that the binder resin 3 was replaced with the binder resin 4.

COMPARATIVE EXAMPLES 1 THROUGH 3

The same procedure as in Example 1 was followed except that the binder resin 1 was replaced with the binder resins 3, 4 and 5, respectively.

The toners obtained in Examples 1 through 4 are hereinafter referred to as toners 1 through 4, respectively; the toners obtained in Comparative Examples 1 through 3 are referred to as comparative toners 1 through 3, respectively.

39 parts of each toner and 1261 parts of resin-coated iron powder were mixed to yield a developer, and this developer was used to develop images using a commercially available electrophotographic copying machine (the photoconductor drum was amorphous selenium, the rotation rate of the fixing roller was 255 mm/sec, a heat roller temperature in the fixing device was variable, and the oil coater was removed).

While controlling the fixing temperature at 120° to 220° C., fixability of toner image, offset properties, storage stability and resin pulverizability were evaluated. The results are given in Table 2.

The lowest fixing temperature is defined as the fixing roller temperature when the fixing ratio defined below exceeds 70% in measurement of the optical reflection density using a Macbeth reflection densitometer before and after five reciprocations of rubbing the image fixed through the fixing device with a sand eraser rubber having a 15 mm×7.5 mm base loaded with a 500 g weight.

Fixing ratio = image density after rubbing/image density before rubbing

Hot offset occurrence temperature was evaluated by visual inspection.

Storage stability was evaluated on the basis of the degree of aggregation after 50 g of each toner was kept standing at a temperature of 50° C. and a relative humidity of 40% for 24 hours.

When the amount remaining on the 42-mesh sieve was less than 3 g, the toner was judged as good in storage stability, and when it exceeded 3 g, the toner was judged as poor in storage stability.

Resin pulverizability was evaluated in a simple pulverization test. Specifically, the resin after ordinary pulverization was sieved to obtain resin powder which passed through the 16-mesh sieve and which did not pass through the 20-mesh sieve. 30.00 g of this classified resin powder was accurately weighed and pulverized using a coffee mill (Phlips HR-2170 model) for 15 seconds, after which it was sieved through a 32-mesh sieve. The resin which did not pass the sieve was accurately weighed. This weight is represented by A in gram. Then, the following equation is used to calculate the percent residue of the resin powder.

Percent residue (%) = [A (g)/resin weight before coffee mill pulverization (30.00 g)] × 100

The procedure described above was repeated three times, and the average was obtained for the three runs. The evaluation criteria based on average percent residue are [◎] for 0 to 15.0%, [○] for 15.1 to 30.0%, [Δ] for 30.1 to 45.0% and [×] for 45.1 to 100%.

TABLE 2

| Toner | Image density | Lowest fixing temperature (°C.) | Hot offset occurence (°C.) | Storage stability | Resin pulverizability |
|---|---|---|---|---|---|
| Toner 1 | 1.36 | 132 | 220< | good | ◎ |
| Toner 2 | 1.35 | 139 | 220< | good | ◎ |
| Toner 3 | 1.35 | 128 | 220< | good | ◎ |
| Toner 4 | 1.33 | 129 | 220< | good | ◎ |
| Comparative toner 1 | 1.35 | 155 | 220< | good | X |

TABLE 2-continued

| Toner | Image density | Lowest fixing temperature (°C.) | Hot offset occurence (°C.) | Storage stability | Resin pulverizability |
|---|---|---|---|---|---|
| Comparative toner 2 | 1.36 | 152 | 220< | good | ○ |
| Comparative toner 3 | 1.34 | 123 | 170 | poor | ⊙ |

As is evident from Table 2, the toners 1 through 4 according to the present invention were low in the lowest fixing temperature, good in storage stability, good in resin pulverizability and good in pulverizability during toner preparation. On the other hand, the comparative toner 1 was high in the lowest fixing temperature because it incorporates the binder resin 3, which has a low content of the unreacted monomer of bisphenol A alkylene oxide adduct. It was also poor in resin pulverizability and pulverizability during toner preparation. The comparative toner 2 was high in the lowest fixing temperature because it incorporates the binder resin 4, which contains no unreacted monomer of bisphenol A alkylene oxide adduct. The comparative toner 3 was low in hot offset occurrence temperature and poor in storage stability, though the lowest fixing temperature was low, because it incorporates the binder resin 5, which has a high content of the unreacted monomer of bisphenol A alkylene oxide adduct.

What is claimed is:

1. A developer composition for electrophotography containing a binder resin consisting essentially of a polyester resin, a colorant and a bisphenol A alkylene oxide adduct, wherein said bisphenol A alkylene oxide adduct is an unreacted monomer in a ratio of not less than 1.0 part by weight and not more than 10.0 parts by weight based on 100 parts by weight of the binder resin.

2. The developer composition for electrophotography according to claim 1, wherein said bisphenol A alkylene oxide adduct is represented by the formula:

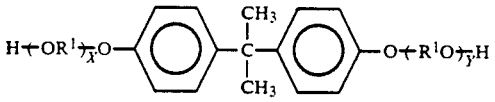

wherein $R^1$ represents an alkylene group having a carbon number of 2 to 4; and X and Y independently represent positive integers which total 2 to 16, on average.

3. The developer composition for electrophotography according to claim 2, wherein said bisphenol A alkylene oxide adduct is selected from the group consisting of polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxyethylene(2.5)-2,2-bis(4-hydroxyphenyl)propane, polyoxypropylene(2.0)-polyoxyethylene(2.0)-2,2-bis(4-hydroxyphenyl)propane and polyoxypropylene(6.0)-2,2-bis(4-hydroxyphenyl)propane.

4. The developer composition for electrophotography according to claims 1, 2 or 3, wherein said polyester resin contains at least one kind of trifunctional compound or higher polyfunctional compound as a constituent unit thereof in a ratio of not less than 0.5 mol % and below 15.0 mol %, based on the total monomer content.

5. The developer composition for electrophotography according to claim 4, wherein said trifunctional compound or higher polyfunctional compound is a triol or higher polyol or a tricarboxylic acid or higher polycarboxylic acid, an anhydride thereof or a lower alkyl ester thereof, or mixtures thereof.

6. The developer composition for electrophotography according to claim 5, wherein said triol or higher polyol is selected from the group consisting of sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxymethylbenzene, and said tricarboxylic acid or higher polycarboxylic acid is selected from the group consisting of 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxylpropane, 1,2,4-cyclohexanetricarboxylic acid, tetra(methylenecarboxyl)methane, 1,2,7,8-octanetetracarboxylic acid, pyromellitic acid and Empol trimer acid.

7. The developer composition for electrophotography according to claims 1, 2 or 3 wherein said polyester resin has a softening point of not less than 95.0° C. and not more than 160.0° C. as determined using a flow tester of the "koka-shiki" type, a glass transition temperature of not less than 50.0° C. and not more than 80.0° C. as determined using DSC and an acid value of not more than 20 KOH mg/g.

8. The developer composition for electrophotography according to claim 7 wherein said polyester resin contains at least 1,2,4-benzenetricarboxylic anhydride.

9. The developer composition for electrophotography according to claim 1, wherein said bisphenol A alkylene oxide adduct is an unreacted monomer in a ratio of not less than 3.0 parts by weight, based on 100 parts by weight of said binder resin.

10. The developer composition for electrophotography according to claim 9, wherein said bisphenol A alkylene oxide adduct is an unreacted monomer in a ratio of not more than 7.0 parts by weight, based on 100 parts by weight of said binder resin.

11. The developer composition for electrophotography according to claim 1, wherein said polyester resin is at least partially crosslinked.

* * * * *